US006840989B2

(12) United States Patent
Dietl

(10) Patent No.: US 6,840,989 B2
(45) Date of Patent: Jan. 11, 2005

(54) CORROSION INHIBITOR FOR BATHING WATER CONTAINING SODIUM CHLORIDE AND MAGNESIUM SULFATE

(75) Inventor: Harald Artur Dietl, Kastl (DE)

(73) Assignee: Clariant GmbH, Frankfurt (DE)

( * ) Notice: Subject to any disclaimer, the term of this patent is extended or adjusted under 35 U.S.C. 154(b) by 0 days.

(21) Appl. No.: 10/474,657

(22) PCT Filed: Apr. 3, 2002

(86) PCT No.: PCT/EP02/03699

§ 371 (c)(1),
(2), (4) Date: Oct. 14, 2003

(87) PCT Pub. No.: WO02/083987

PCT Pub. Date: Oct. 24, 2002

(65) Prior Publication Data

US 2004/0112249 A1 Jun. 17, 2004

(30) Foreign Application Priority Data

Apr. 14, 2001 (DE) ..... 101 18 684

(51) Int. Cl.[7] ..... C23F 11/167; C23F 11/18

(52) U.S. Cl. ..... 106/14.12; 106/14.44; 210/700; 252/175; 422/15

(58) Field of Search ..... 106/14.12, 14.44; 210/700; 252/175; 422/15

(56) References Cited

U.S. PATENT DOCUMENTS

| | | | | |
|---|---|---|---|---|
| 3,547,817 A | * | 12/1970 | Guthrie | 210/700 |
| 3,617,576 A | * | 11/1971 | Kerst | 210/699 |
| 3,629,124 A | * | 12/1971 | King | 510/228 |
| 3,723,333 A | | 3/1973 | von Freyhold | 252/175 |
| 3,837,803 A | | 9/1974 | Carter et al. | 21/2.7 |
| 3,933,427 A | | 1/1976 | Bohnsack et al. | 21/2.7 A |
| 4,298,568 A | * | 11/1981 | Gerhardt et al. | 422/16 |
| 4,501,667 A | | 2/1985 | Cook | 210/700 |
| 4,734,257 A | * | 3/1988 | Penninger | 422/13 |
| 4,855,071 A | | 8/1989 | Todd, Jr. et al. | 252/70 |
| 4,954,279 A | | 9/1990 | Ma et al. | 252/70 |
| 5,238,592 A | | 8/1993 | Stankowiak et al. | 252/70 |
| 5,320,779 A | * | 6/1994 | Fivizzani | 252/394 |
| 5,376,293 A | | 12/1994 | Johnston | 252/70 |
| 5,435,930 A | | 7/1995 | Chan et al. | 252/70 |
| 6,032,304 A | | 3/2000 | Nam | 4/488 |
| 6,059,989 A | | 5/2000 | Stankowiak et al. | 252/70 |
| 6,149,833 A | | 11/2000 | Dietl et al. | 252/70 |
| 6,156,226 A | | 12/2000 | Klyosov et al. | 252/70 |

FOREIGN PATENT DOCUMENTS

| | | |
|---|---|---|
| DE | 1 767 454 | 9/1971 |
| DE | 2 225 645 | 1/1974 |
| DE | 2 335 331 | 2/1974 |
| DE | 4034 217 | 5/1991 |
| DE | 101 18 685 | 8/2002 |
| EP | 0 483 721 | 5/1992 |
| EP | 0 579 014 | 1/1994 |
| EP | 0 822 270 | 2/1998 |
| EP | 0 992 562 | 4/2000 |
| GB | 1 589 109 | 5/1981 |

OTHER PUBLICATIONS

English abstract for JP publication No. 55002718, Jan. 10, 1980.
English abstract for JP publication No. 09–249553, Sep. 22, 1997.
English abstract for DE 4034 217, May 29, 1991.

* cited by examiner

*Primary Examiner*—Anthony J. Green
(74) *Attorney, Agent, or Firm*—Richard P. Silverman

(57) ABSTRACT

The present invention relates to a corrosion inhibitor for bathing waters which contain chlorides and sulfates, in particular sodium chloride and magnesium sulfate, that reduces the corrosion effect of such bathing water on metallic materials, in particular steels (structural steel) and brass. The corrosion inhibitor of the present invention is based on a composition comprising phosphates, zinc chloride and aminotrimethylenephosphonic acid.

6 Claims, No Drawings

CORROSION INHIBITOR FOR BATHING WATER CONTAINING SODIUM CHLORIDE AND MAGNESIUM SULFATE

The present invention relates to a corrosion inhibitor for bathing waters which contain chlorides and sulfates, in particular sodium chloride and magnesium sulfate, that reduces the corrosion effect of such bathing water on metallic materials, in particular steels (structural steel) and brass.

Recently, "fit for fun" has become a major part of the leisure trend in our health-conscious society. The magic formula "wellness", a modern term for recreation in order to increase the quality of life, is therefore entirely pertinent to the prevailing spirit of the times. Wellness is not, as might be believed at a first glance, the coining of a newfangled word but has for centuries been defined as a state of vital wellbeing. In the US, this trend has long been integrated in social policy, for motives which are not entirely selfless. In order to reduce the constantly increasing health insurance costs, there has for years been very successful investment in wellness health care in the U.S.

Modern medical discoveries have confirmed that salt-containing swimming pool water, whether salt water without accompanying substances, sea water from the Red Sea or thermal natural brine, is outstandingly suitable for increasing wellbeing. The salt content of the wellness bath is usually 0.4% (sea water: 3.6%).

U.S. Pat. No. 6,032,304 describes the addition of various alkali metal and alkaline earth metal halides and also sulfates in order to establish various densities of the bathing water and to achieve buoyancies depending on said bathing water.

JP-09 249 553 A2 (Derwent Abstract) reports a positive effect of the use of rock salt or sea salt on the skin.

The addition of chlorides to pool water was as far as possible avoided in the past since this results in chloride-induced corrosion phenomena. In order to be able to some extent to control these corrosion phenomena, such as, for example, pitting corrosion or uniform corrosion, a sufficiently large amount of molybdenum was added to the materials in the past or oxidizing agent was added to the swimming pool medium. Pitting corrosion is partial attack by halides, in particular chlorides. The chlorides destroy the passive layer of the metals. Uniform corrosion is uniform removal of the surface owing to the corrosive effect of salt-containing pool water. This corrosion is evident in particular from the rusting of structural steel and brass.

However, chlorides cannot be entirely avoided as a component of bathing water. Reference may be made only to natural, chloride-containing bathing water, such as, for example, in saline pools.

It was therefore an object of the present invention to provide a corrosion inhibitor which prevents the corrosion of metals which is caused by chloride- and sulfate-containing bathing water.

Surprisingly, it has now been found that a corrosion inhibitor based on phosphates, zinc chloride and aminotrimethylenephosphonic acid has the required effect.

The invention therefore relates to a corrosion inhibitor for chloride- and sulfate-containing bathing water, which can be prepared by mixing a) from 10 to 40% by weight of phosphoric acid, b) from 5 to 25% by weight of an alkali metal hydroxide, c) from 0.01 to 10% by weight of zinc chloride, d) from 0.01 to 5% by weight of aminotrimethylenephosphonic acid and e) water to 100% by weight.

Phosphoric acid is generally used in concentrated form, i.e. 85% strength. The amount of phosphoric acid is preferably between 12 and 25% by weight, in particular between 14 and 16% by weight.

The alkali metal hydroxide is preferably sodium hydroxide or potassium hydroxide. It may be used in solid form or in the form of aqueous solutions. The amount of alkali metal hydroxide is preferably between 12 and 18% by weight, in particular between 14 and 16% by weight.

The amount of zinc chloride is preferably between 1 and 4% by weight, in particular between 1.5 and 2.5% by weight.

Aminotrimethylenephosphonic acid is used in general in the form of an aqueous solution which has a content of about 50% by weight. The amount of aminotrimethylenephosphonic acid is preferably between 0.1 and 1% by weight, in particular between 0.15 and 0.4% by weight.

The invention furthermore relates to the use of the corrosion inhibitor according to the invention in amounts of from 0.01 to 0.5% by weight, based on the weight of the bathing water, for inhibiting the corrosion of steel and brass which are in contact with chloride- and sulfate-containing bathing water.

A significant technical advantage of the corrosion inhibitor according to the invention is its efficiency in the virtually neutral pH range between 7 and 8, in particular from 7.2 to 7.6.

The pH of swimming pool water is usually between 7.2 and 7.6. In the technical world, a corrosion inhibitor which offers sufficient corrosion protection at a pH between 7.2 and 7.6 has been sought unsuccessfully to date. Usually, the conventional inhibitors operate at a pH of greater than 9. For this reason, chemical corrosion inhibitors have been used to date only to a limited extent for corrosion control at a pH of between 7 and 8. The advantage of this inhibition compared with the prior art is that very small amounts of corrosion inhibitor are sufficient to lead to effective minimization of the corrosion phenomena on steel, structural steel and brass. Owing to the very small amounts used, corrosion protection can be achieved with very small financial resources.

EXAMPLES 0.05% by weight of an inhibitor consisting of 67.18% by weight of water, 15.20% by weight of 85% strength phosphoric acid, 15.29% by weight of 45% strength potassium hydroxide, 2.04% by weight of zinc chloride and 0.23% by weight of aminotrimethylenephosphonic acid was added to a bathing water.

TABLE 1

Composition of the test waters (C = comparative experiment)

| | Contents in % by weight | | | | |
|---|---|---|---|---|---|
| Example | Water | NaCl | $MgSO_4$ | Inhibitor | Disinfection |
| 1 | to 100 | 2.7 | 0.3 | 0.0003 | — |
| 2 | to 100 | 2.7 | 0.3 | 0.0003 | 15 mg/day |
| 3(C) | to 100 | 2.7 | 0.3 | — | — |
| 4(C) | to 100 | 2.7 | 0.3 | — | 15 mg/day |

TABLE 2

Corrosion rates in mg · $cm^{-2}$ · 24 $h^{-1}$ on structural steel RST, depending on the action (in days)

| Example | Water according to example | Action time | Corrosion rate |
|---|---|---|---|
| 5 | 1 | 7 | −0.12 |
| 6 | 1 | 14 | −0.10 |
| 7 | 1 | 21 | −0.12 |
| 8 | 1 | 28 | −0.11 |
| 9 | 2 | 7 | −0.08 |
| 10 | 2 | 14 | −0.10 |
| 11 | 2 | 21 | −0.12 |
| 12 | 2 | 28 | −0.18 |
| 13 | 3 | 7 | −0.10 |
| 14 | 3 | 14 | −0.18 |
| 15 | 3 | 21 | −0.25 |
| 16 | 3 | 28 | −0.27 |
| 17 | 4 | 7 | −0.28 |
| 18 | 4 | 14 | −0.24 |
| 19 | 4 | 21 | −0.28 |
| 20 | 4 | 28 | −0.45 |

What is claimed is:

1. A corrosion inhibitor for chloride- and sulfate-containing bathing water, prepared by mixing a) from 10 to 40% by weight of phosphoric acid, b) from 5 to 25% by weight of an alkali metal hydroxide, c) from 0.01 to 10% by weight of zinc chloride, d) from 0.01 to 5% by weight of aminotrimethylenephosphonic acid and e) water to 100% by weight.

2. The corrosion inhibitor as claimed in claim 1, comprising between 12 and 25% by weight of phosphoric acid.

3. The corrosion inhibitor as claimed in claim 1, comprising between 1 and 4% by weight of zinc chloride.

4. The corrosion inhibitor of claim 1, comprising between 0.1 and 1% by weight of aminotrimethylenephosphonic acid.

5. The corrosion inhibitor of claim 1, comprising between 12 and 18% by weight of alkali metal hydroxide.

6. A method for inhibiting the corrosion of steel and brass which are in contact with chloride- and sulfate-containing bathing water, said method comprising adding to said bathing water from 0.01 to 0.5% by weight of the corrosion inhibitor of claim 1.

* * * * *